United States Patent [19]

Uchida et al.

[11] Patent Number: 4,546,051

[45] Date of Patent: Oct. 8, 1985

[54] ALUMINUM COATED STEEL SHEET AND PROCESS FOR PRODUCING THE SAME

[75] Inventors: Yukio Uchida, Sakai; Kazuhiro Takagi, Amagasaki; Kiichiro Katayama, Funabashi; Hisao Kawase, Kure, all of Japan

[73] Assignee: Nisshin Steel Co., Ltd., Tokyo, Japan

[21] Appl. No.: 619,804

[22] Filed: Jun. 12, 1984

Related U.S. Application Data

[63] Continuation of Ser. No. 396,359, Jul. 8, 1982, abandoned.

[51] Int. Cl.[4] ..... C23C 1/08

[52] U.S. Cl. ..... 428/653; 148/11.5 Q; 148/127

[58] Field of Search ..... 428/653; 148/11.5 Q, 148/127

[56] References Cited

U.S. PATENT DOCUMENTS

| | | | |
|---|---|---|---|
| 2,965,963 | 12/1960 | Batz et al. | 428/653 |
| 3,705,023 | 12/1972 | Fisters, Jr. | 428/653 |
| 3,881,880 | 5/1975 | Gomersall | 428/653 |
| 4,144,378 | 3/1979 | Kim | 428/653 |

FOREIGN PATENT DOCUMENTS

| | | | |
|---|---|---|---|
| 56-5964 | 1/1981 | Japan | 428/653 |
| 56-93854 | 7/1981 | Japan | 428/653 |
| 56-102556 | 8/1981 | Japan | 428/653 |
| 57-32357 | 2/1982 | Japan | 148/11.5 Q |

*Primary Examiner*—L. Dewayne Rutledge
*Assistant Examiner*—Deborah Yee
*Attorney, Agent, or Firm*—Kane, Dalsimer, Kane, Sullivan and Kurucz

[57] ABSTRACT

An aluminum coated steel sheet having excellent formability and corrosion resistance comprising a steel substrate of a recrystallized structure, an Al—Si coating layer of a recrystallized structure on at least one surface of the substrate, and a discontinuous intermediate layer of Al—Fe—Si intermetallic compounds. The product may be conveniently produced by rolling an Al—Si hot dipped steel sheet and annealing the rolled sheet under suitably selected conditions.

5 Claims, 4 Drawing Figures

ALUMINUM COATED STEEL SHEET AND PROCESS FOR PRODUCING THE SAME

This is a continuation of application Ser. No. 396,359, filed July 8, 1982, now abandoned.

BACKGROUND OF THE INVENTION

The present invention relates to an aluminum coated steel sheet having formability and corrosion resistance and to a process for the production thereof.

Aluminum hot dipped steel sheet products, prepared using a practically 100% aluminum hot dipping bath, have satisfactory weather and corrosion resistances. They pose, however, a problem in their formability owing to the presence of a relatively thick (e.g. about 20 μm) intermediate layer of intermetallic compounds formed between the steel substrate and aluminum coating layer. They have a drawback in that when bent, pressed, drawn or otherwise mechanically worked even at a slight working rate, the intermediate layer often cracks and the coating layer or layers frequently peel off. For this reason, it has become the practice to add silicon to an aluminum hot dipping bath thereby to control the growth of the intermediate layer of intermetallic compounds to a thickness of about 2 to 4 μm. The product, Al—Si hot dipped steel sheet, having a good formability as well as excellent heat and corrosion resistance, is widely used for various applications.

With such an Al—Si hot dipped steel sheet, there still remains a problem in that when worked at a severe working rate, the Al—Si coating layer or layers often readily crack, and pits of red rust appear relatively early and develop in those areas of the steel substrate where the coating layer or layers have cracked. This is partly because the Al—Si coating layer has a cast structure of an insufficient elongation, and partly because the continuous intermediate layer, essentially consisting of Al—Fe—Si intermetallic compounds and having a thickness of about 2.0 to 4.0 μm, often locally cracks at the time of working, leading to localized concentration of internal stress in the coating layer.

SUMMARY OF THE INVENTION

It has now been found that an improved aluminum coated steel sheet can be produced by transforming the structure of the Al—Si coating layer or layers to a recrystallized structure and dividing the intermediate layer of Al—Fe—Si intermetallic compounds into sections. By the term "formability" of an aluminum coated steel sheet, we mean the ability of the sheet to be formed into shapes by mechanical working such as bending, pressing or drawing without the coating layer or layers cracking or peeling off.

The invention provides an aluminum coated steel sheet comprising (1) a steel substrate containing 0.002 to 0.02% by weight of solute N and not more than $\sqrt{5/3N}-1/300\%$ by weight of total C, wherein N represents the percentage of the solute N, and having a recrystallized structure;

(2) an aluminum coating layer on at least one surface of said steel substrate comprising essentially Al and 1 to 15% by weight of Si and having a recrystallized structure; and (3) a discontinuous intermediate layer at the interface between said steel substrate and aluminum coating layer and comprising essentially Al—Fe—Si intermetallic compounds.

The invention further provides a process for the production of an aluminum coated steel sheet comprising the steps of (a) rolling an aluminum coated steel sheet, which comprises a steel substrate containing 0.002 to 0.02% by weight of solute N and not more than $\sqrt{5/3N}-1/300\%$ by weight of total C, wherein N represents the percentage by weight of the solute N; an aluminum coating layer on at least one surface of said steel substrate comprising essentially Al and 1 to 15% by weight of Si; and a continuous intermediate layer at the interface between said steel substrate and aluminum coating layer and comprising essentially Al—Fe—Si intermetallic compounds, at a rolling rate sufficient to divide said continuous intermediate layer into sections, and (b) annealing the rolled aluminum coated steel sheet at a temperature sufficient for the recrystallization of said steel substrate but insufficient for Al—Fe mutual diffusion between said steel substrate and aluminum coating layer.

DETAILED DESCRIPTION OF THE INVENTION

Figure 1A:
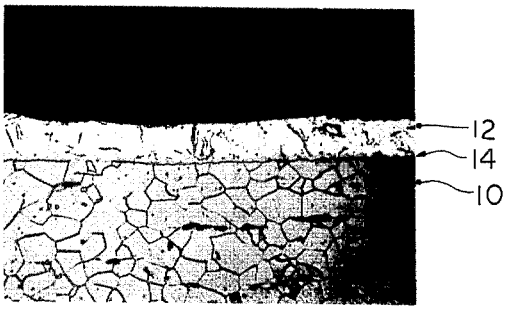
FIG. 1(*a*) and FIG. 1(*b*) are photographs showing respectively a longitudinal cross-section of a prior art aluminum coated steel sheet and that of a product in accordance with the invention at a magnification of 400.
Figure 1B:
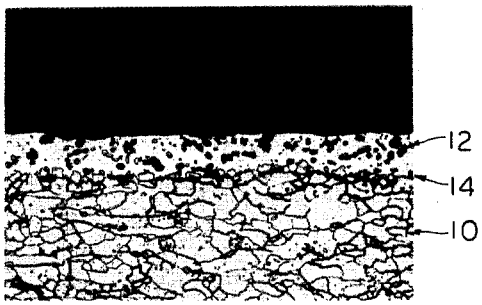

Referring to FIG. 1(*a*) a prior art aluminum hot dipped steel sheet comprises a steel substrate 10 having a recrystallized structure, an Al—Si coating layer 12 of a cast structure formed on at least one surface of the steel substrate and a continuous intermediate layer 14 between the steel substrate and Al—Si coating layer and comprising essentially Al—Fe—Si intermetallic compounds. In contrast, referring to FIG. 1(*b*), an aluminum coated steel sheet according to the invention comprises a steel substrate 10 having a recrystallized structure, an Al—Si coating layer 12 having a recrystallized structure on at least one surface of the steel substrate and a divided discontinuous intermediate layer 14 at the interface between the steel substrate and Al—Si coating layer and essentially consisting of Al—Fe—Si intermetallic compounds. Because of the discontinuous nature of the intermediate layer 14, the steel substrate 10 is directly in contact with the Al—Si coating layer 12 in some places while there are Al—Fe—Si intermetallic compounds interposed between the steel substrate and Al—Si coating layer in other places.

We have found that silicon has been spheroidized in the recrystallized Al—Si coating layer and that the recrystallized Al—Si coating layer has an elongation about twice that of a coating layer of the same composition having a cast structure. As demonstrated in the Examples hereinafter, the product in accordance with the invention has superior formability to that of the prior art product in that the former does not crack in its coating layer or layers even if severely worked. It is believed that this is partly because the product of the invention has a coating layer or layers of a good elongation as mentioned above and partly because owing to the presence of the suitably divided discontinuous intermediate layer the stress is dispersed when the product is worked, leading to a reduction in localized concentration of internal stress. As to the corrosion resistance of worked areas the product of the invention is extremely superior to the prior art product since the coating layer or layers of the former do not crack in worked areas. In addition, we have found as demonstrated in the Examples hereinafter that the corrosion resistance of flat areas (unworked areas) of the product according to the invention is also much superior to that of the prior art product. It is believed that this is because pin holes which originally exist in the coating layer or layers of a cast structure disappear in the rolling step so that the formation of red rust pits is controlled.

It is preferred that the divided discontinuous intermediate layer, when observed on a longitudinal cross-section (that is a cross-section taken along the direction of rolling), comprises successive discrete islands comprising essentially Al—Fe—Si intermetallic compounds, the individual islands having an average size of not larger than 10 μm with the sum of gaps between adjacent islands being 10 to 50% of the total length.

Figure 2:
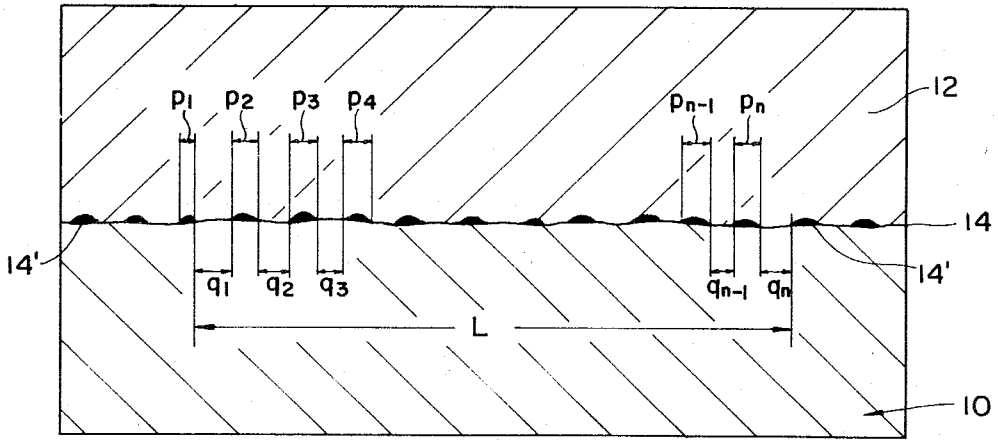
FIG. 2 is a cross-sectional view of a rolled aluminum coated steel sheet taken along the direction of rolling, for illustrating the parameters P and Q used herein for representing the extent of the division of the intermediate layer.

FIG. 2 is a cross-sectional view of a rolled aluminum coated steel sheet taken along the direction of rolling. When an aluminum hot dipped steel sheet having a continuous intermediate layer is rolled under suitably selected conditions, the intermediate layer 14 is divided into sections 14'. As shown in FIG. 2, the intermediate layer so divided comprises successive discrete islands 14', when observed on a longitudinal cross-section. If the sizes of successive n islands, are $p_1, p_2 \ldots p_n$, the gaps between adjacent islands are $q_1, q_2 \ldots q_n$, and L, the total length is the sum of the sizes of the islands and the gaps between adjacent islands, i.e., $L=(p_1+p_2+\ldots p_n)+(q_1+q_2+\ldots q_n)$ the average size P of the islands can be expressed by $$P = \frac{p_1 + p_2 + \ldots p_n}{n} \ (\mu m)$$

while the percentage Q of the sum of the gaps between adjacent islands based on the total length can be expressed by $$Q = \frac{q_1 + q_2 + \ldots q_n}{L} \times 100 \ (\%)$$

A preferred extent of the division of the intermediate layer 14 is such that P is not larger than 10 μm with Q being 10 to 50%. For the purposes of such observation n should be at least 20. If P is substantially larger than 10 μm with Q being substantially less than 10%, that is if the individual successive islands are relatively large with relatively small gaps between adjacent islands, the coating layer may crack when the product is severely worked, probably due to localized concentration of internal stress in those areas of the coating layer which correspond to the small gaps of the divided intermediate layer. Whereas with rolling resulting in Q substnatially in excess of 50% the rolled sheet may have many microcracks in its coating, which do not disappear in the subsequent annealing step, leading to a reduction in the corrosion resistance of the final product. We have found that in many cases the preferred extent of the division of the intermediate layer may be achieved by rolling with a rolling rate of 30 to 70%.

The aluminum coated steel sheet according to the invention may be conveniently prepared by rolling an aluminum coated steel sheet comprising a steel substrate, an Al—Si coating layer on at least one surface of the steel substrate and a continuous intermediate layer of Al—Fe—Si intermetallic compounds between the steel substrate and Al—Si coating layer, and annealing the so-rolled sheet. The starting aluminum coated steel sheet is conveniently prepared by a hot dipping technique. It should be pointed out, however, that when an Al—Si hot dipped steel sheet which has been prepared from a typical low carbon rimmed steel strip, for example, containing 0.07% by weight of C, 0.21% by weight of Mn, a trace of Si, 0.007% by weight of P, 0.013% by weight of S and 0.0024% by weight of N, the balance being Fe and impurities, is rolled with a rolling rate of 50% and then annealed at a temperature of 480° C., the steel substrate is not recrystallized; rather in the course of annealing Al—Fe binary intermetallic compounds such as $Al_3Fe$ and $Al_5Fe_2$ are formed and grow owing to the Al—Fe mutual diffusion at the interface between the steel substrate and Al—Si coating layers, whereby the surfaces of the product are badly discolored dark grey. When such a product is mechanically worked, its coating layers readily peel off since the abovementioned binary intermetallic compounds are very hard and brittle. On the one hand it is necessary to anneal the rolled sheet at a temperature of about 500° C. to recrystallize the rolled steel substrate. On the other hand such a recrystallization starting temperature of about 500° C. is well within the range of temperatures at which the Al—Fe binary intermetallic compounds are formed. It is therefore impossible to obtain satisfactory products starting from steel having the composition as illustrated above by a combination of steps of Al-Si hot dipping, rolling and annealing.

We have found that if the total C and solute N content of the steel substrate are suitable, there is a certain range of temperature at which the rolled steel substrate can be recrystallized without the formation of the Al—Fe binary intermetallic compounds resulting from Al—Fe mutual diffusion.

It has been found that the solute N content in the steel substrate should be at least 0.002% by weight in order to avoid the undesired formation of the Al—Fe binary intermetallic compounds at temperatures sufficient for the recrystallization of the rolled steel substrate. The higher the solute N content, the more effectively the formation of the Al—Fe binary intermetallic compounds can be controlled. However, an excessive solute N renders the steel sheet unduly hard, and therefore the solute N content of steel should be not more than 0.02% by weight. Although the mechanism by which the solute N in steel serves to control the formation of the Al—Fe intermetallic compounds is not yet exactly understood, it is believed that N enters Fe interstitially thereby increasing the activation energy for Al to diffuse into Fe, tending to prevent the formation of the Al—Fe intermetallic compounds.

It has been also found that with the same solute N content the lower the total C content the higher the temperature of formation of the Al—Fe binary intermetallic compounds in general. Although the precise mechanism for this is not yet exactly understood, it is believed that C in steel exceeding its solubility exists in the form of $Fe_3C$, which provides N with a certain solubility and thus serves to lower the effective solute N content.

The starting aluminum coated steel sheet suitable for use in the production of the products in accordance with the invention, thus contains in its steel substrate 0.002 to 0.02% by weight of solute N and, depending upon the solute N content, not more than $\sqrt{5/3N-1/300}$% by weight of total C wherein N represents the percentage by weight of the solute N.

Figure 3:
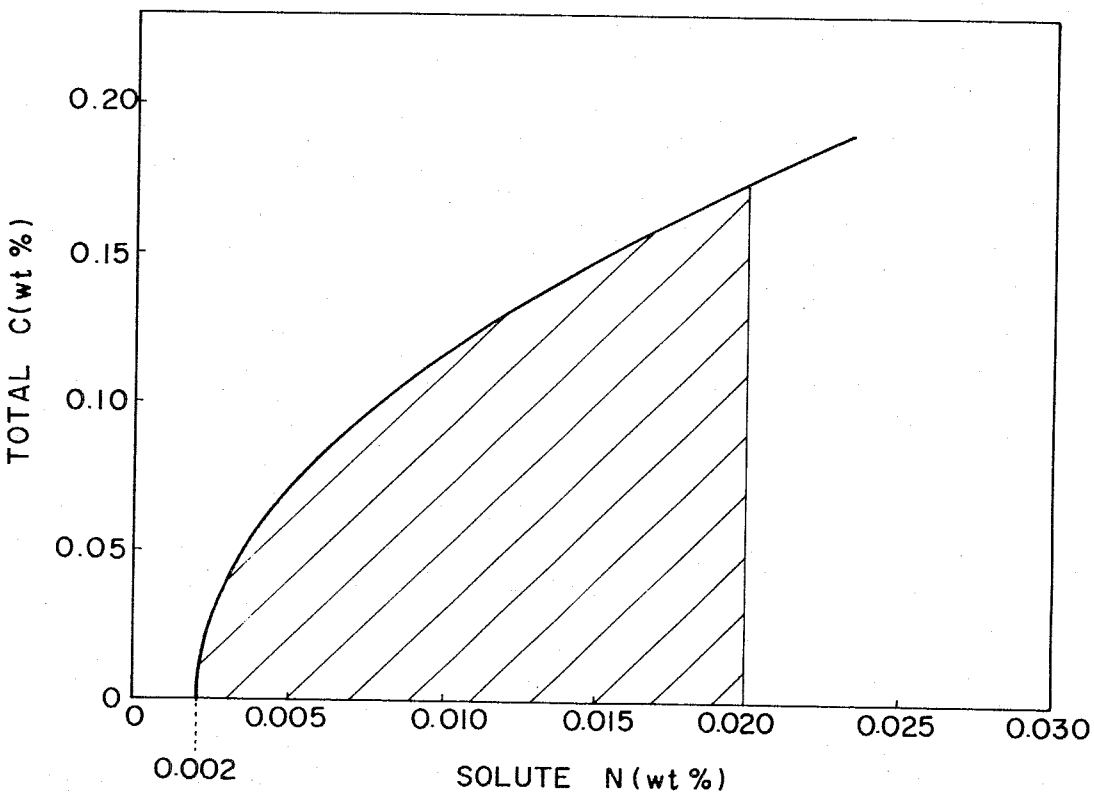
FIG. 3 is a graph showing the ranges of suitable total carbon and solute nitrogen content in steel in the practice of the invention.

FIG. 3 shows the ranges of suitable total C and solute N content in steel in both the products according to the invention and the starting aluminum coated steel sheets usable for the production of the products of the invention. Provided that the total C and solute N content in steel of the starting aluminum coated steel sheet fall within the hatched area shown in FIG. 3, there is a certain range of temperature at which the rolled steel sheet can be recrystallized without the formation of the Al—Fe binary intermetallic compounds. It is advantageous to select the total C and solute N content in steel so that such a range of temperature is broad.

In addition to the C and N, the steel may contain up to 0.03% by weight of Si, up to 0.4% by weight of Mn, up to 0.02% by weight of P, up to 0.02% by weight of S and up to 0.01% by weight of acid soluble Al. We have confirmed that with Si, Mn, P, S and acid soluble Al being within the prescribed ranges, the recrystallization behavior of steel and the effect of N and C in controlling of the formation of the Al—Fe binary intermetallic compounds discussed above are substantially unchanged.

It has been found that the Si content in the aluminum coating layer significantly affects the results of rolling. An aluminum coated steel sheet, prepared by hot dipping in an aluminum hot dipping bath containing Si in an amount of substantially less than 1% by weight, and thus having Al—Si coating layers whose Si content is substantially less than 1% by weight, has a thick continuous intermediate layer of about 15 to 20 μm in thickness, and when rolled, irrespective of the rolling rate, the thick intermediate layer does not become suitably divided into sections, but only cracks letting the coating layers readily peel off. However, an aluminum coated steel sheet, prepared by hot dipping in an aluminum hot dipping bath containing Si substantially in excess of 15%, and thus, having Al—Si coating layers whose Si content is substantially in excess of 15%, contains hard and brittle platelets of Si in its coating layers, and when rolled even with a relatively low rolling rate, the coating layers cracks heavily and locally peel off. For these reasons, the Si content in the coating layer needs to be controlled within the range of 1.0 to 15% by weight.

In the first step of the process according to the invention, the starting aluminum coated steel sheet which comprises a steel substrate containing 0.002 to 0.02% by weight of solute N and not more than 5/3N-1/300% by weight of total C, wherein N represents the percentage by weight of the solute N; an aluminum coating layer on at least one surface of said steel substrate comprising essentially Al and 1 to 15% by weight of Si, and; a continuous intermediate layer between said steel substrate and aluminum coating layer and comprising essentially Al—Fe—Si intermediate compounds, is rolled so that the continuous intermediate layer is divided into sections. Preferably, the rolling step is carried out at a rolling rate sufficient to divide the continuous intermediate layer into successive discrete islands when observed on a cross-section taken along the direction of rolling, the individual islands having an average size (P) of not larger than 10 μm with the percentage (Q) of the sum of gaps between adjacent islands based on the total length l being 10 to 50%. We have found that in many cases the preferred extent of the division of the intermediate layer may be achieved by rolling with a rolling rate of 30 to 70%. When the rolling is too mild the intermediate layer is not suitably divided into sections. Whereas with an excessively severe rolling rate many micro-cracks are formed in the coating layer or layers and do not disappear even if subsequently annealed.

In the second step of the process according to the invention, the rolled sheet from the first step is annealed at a temperature sufficient for the recrystallization of the steel substrate but insufficient for the Al—Fe mutual diffusion between the steel substrate and aluminum coating layer. As described above, provided that the solute N and total C content in the steel are suitable, the recrystallization starting temperature of the rolled steel substrate can be lower than the temperature at which the Al—Fe binary intermetallic compounds are formed by mutual diffusion, and thus, there is a certain range of temperature at which the steel substrate can be recrystallized without suffering from Al—Fe mutual diffusion. The annealing step is carried out at a temperature within such a range. By the annealing, the steel substrate and coating layer or layers are recrystallized. Even in a case wherein the temperature of formation of the binary intermetallic compounds is well above 600° C., the annealing step should preferably be carried out at a temperature not higher than 600° C. If annealed at a temperature substantially above 600° C., the coating layer or layers frequently melt.

The thickness (mm) of the starting aluminum coated steel sheet and the coating build-up ($g/m^2$) are not strictly critical. In fact, advantageous properties of the product in accordance with the invention are not lost by repeating the rolling and annealing steps until the desired final thickness is reached. The coating build-up of the starting aluminum coated steel sheet may be determined depending upon the desired coating build-up in the final product.

As described above and as demonstrated in the Examples below, the aluminum coated steel sheet in accordance with the invention has excellent formability and corrosion resistance, when compared with the previously available comparable products. In addition, the product according to the invention has an additional advantage in that owing to the rolling step it has a better precision of thickness than the prior art products.

The invention will be further described by the following Examples.

EXAMPLE 1

Rimmed steel strip specimens of a thickness of 0.8 mm having various total C and solute N contents indicated in Table 1, were dipped in an aluminum hot dipping bath containing 10% by weight of Si to prepare aluminum coated steel sheets. Each sheet was rolled at the indicated rolling rate within the range of between 10% and 80%, and annealed for a period of 10 hours at the indicated temperature within the range of between 480° C. and 570° C. Each sample so obtained was examined for the presence of Al—Fe binary intermetallic compounds and for the occurrence of recrystallization in the steel substrate.

The results are shown in Table 1, in which:

A designates that the steel substrate was recrystallize without the formation of any Al—Fe binary intermetallic compounds;

B designates that while the steel substrate was recrystallized, the surfaces of the sample became dark grey due to the formation of the Al—Fe binary intermetallic compounds;

C designates that while binary intermetallic compounds were not formed, the steel substrate was not recrystallized, and;

D designates that binary intermetallic compounds were formed without any recrystallization of the steel substrate.

TABLE 1

Recrystallization of Steel and Temperature of Formation of Al—Fe Intermetallic Compounds

| No. | Contained in Steel % by Weight of total C | solute N | Rolling Rate (%) | Temp. of Anneal (10 hus) 480° C. | 500° C. | 530° C. | 570° C. |
|---|---|---|---|---|---|---|---|
| 1 | 0.005 | 0.0024 | 10 | C | C | D | B |
| 2 | | | 20 | C | C | B | B |
| 3 | | | 40 | C | A | B | B |
| 4 | | | 60 | C | A | B | B |
| 5 | | | 80 | C | A | B | B |
| 6 | 0.004 | 0.0053 | 10 | C | C | C | A |
| 7 | | | 20 | C | C | A | A |
| 8 | | | 40 | C | A | A | A |
| 9 | | | 60 | C | A | A | A |
| 10 | | | 80 | C | A | A | A |
| 11 | 0.004 | 0.0105 | 10 | C | C | C | A |
| 12 | | | 20 | C | A | A | A |
| 13 | | | 40 | C | A | A | A |
| 14 | | | 60 | C | A | A | A |
| 15 | | | 80 | C | A | A | A |
| 16 | 0.005 | 0.0161 | 10 | C | C | A | A |
| 17 | | | 20 | C | A | A | A |
| 18 | | | 40 | C | A | A | A |
| 19 | | | 60 | C | A | A | A |
| 20 | | | 80 | C | A | A | A |
| 21 | 0.022 | 0.0021 | 10 | D | D | B | B |
| 22 | | | 20 | D | B | B | B |
| 23 | | | 40 | D | B | B | B |
| 24 | | | 60 | D | B | B | B |
| 25 | | | 80 | D | B | B | B |
| 26 | 0.019 | 0.0061 | 10 | C | C | A | A |
| 27 | | | 20 | C | A | A | A |
| 28 | | | 40 | C | A | A | A |
| 29 | | | 60 | C | A | A | A |
| 30 | | | 80 | C | A | A | A |
| 31 | 0.020 | 0.0090 | 10 | C | C | A | A |
| 32 | | | 20 | C | A | A | A |
| 33 | | | 40 | C | A | A | A |
| 34 | | | 60 | C | A | A | A |
| 35 | | | 80 | C | A | A | A |
| 36 | 0.021 | 0.0148 | 10 | C | A | A | A |
| 37 | | | 20 | C | A | A | A |
| 38 | | | 40 | C | A | A | A |
| 39 | | | 60 | C | A | A | A |
| 40 | | | 80 | C | A | A | A |
| 41 | 0.048 | 0.0031 | 10 | D | B | B | B |
| 42 | | | 20 | D | B | B | B |
| 43 | | | 40 | D | B | B | B |
| 44 | | | 60 | D | B | B | B |
| 45 | | | 80 | D | B | B | B |
| 46 | 0.044 | 0.0059 | 10 | C | A | A | B |
| 47 | | | 20 | C | A | A | B |
| 48 | | | 40 | C | A | A | B |
| 49 | | | 60 | C | A | A | B |
| 50 | | | 80 | C | A | A | B |
| 51 | 0.042 | 0.0110 | 10 | C | A | A | A |
| 52 | | | 20 | C | A | A | A |
| 53 | | | 40 | C | A | A | A |
| 54 | | | 60 | C | A | A | A |
| 55 | | | 80 | C | A | A | A |

TABLE 1-continued

Recrystallization of Steel and Temperature of Formation of Al—Fe Intermetallic Compounds

| No. | Contained in Steel % by Weight of total C | solute N | Rolling Rate (%) | Temp. of Anneal (10 hus) 480° C. | 500° C. | 530° C. | 570° C. |
|---|---|---|---|---|---|---|---|
| 56 | 0.041 | 0.0187 | 10 | C | A | A | A |
| 57 | | | 20 | C | A | A | A |
| 58 | | | 40 | C | A | A | A |
| 59 | | | 60 | C | A | A | A |
| 60 | | | 80 | C | A | A | A |
| 61 | 0.072 | 0.0025 | 10 | D | B | B | B |
| 62 | | | 20 | D | B | B | B |
| 63 | | | 40 | D | B | B | B |
| 64 | | | 60 | D | B | B | B |
| 65 | | | 80 | D | B | B | B |
| 66 | 0.078 | 0.0051 | 10 | C | A | B | B |
| 67 | | | 20 | C | A | B | B |
| 68 | | | 40 | C | A | B | B |
| 69 | | | 60 | C | A | B | B |
| 70 | | | 80 | C | A | B | B |
| 71 | 0.073 | 0.0112 | 10 | C | A | A | B |
| 72 | | | 20 | C | A | A | B |
| 73 | | | 40 | C | A | A | B |
| 74 | | | 60 | C | A | A | B |
| 75 | | | 80 | C | A | A | B |
| 76 | 0.069 | 0.0165 | 10 | C | A | A | A |
| 77 | | | 20 | C | A | A | A |
| 78 | | | 40 | C | A | A | A |
| 79 | | | 60 | C | A | A | A |
| 80 | | | 80 | C | A | A | A |
| 81 | 0.148 | 0.0032 | 10 | D | B | B | B |
| 82 | | | 20 | D | B | B | B |
| 83 | | | 40 | D | B | B | B |
| 84 | | | 60 | D | B | B | B |
| 85 | | | 80 | D | B | B | B |
| 86 | 0.152 | 0.0052 | 10 | C | B | B | B |
| 87 | | | 20 | C | B | B | B |
| 88 | | | 40 | C | B | B | B |
| 89 | | | 60 | C | B | B | B |
| 90 | | | 80 | C | B | B | B |
| 91 | 0.160 | 0.0104 | 10 | C | B | B | B |
| 92 | | | 20 | C | B | B | B |
| 93 | | | 40 | C | B | B | B |
| 94 | | | 60 | C | B | B | B |
| 95 | | | 80 | C | B | B | B |
| 96 | 0.157 | 0.0181 | 10 | C | A | A | B |
| 97 | | | 20 | C | A | A | B |
| 98 | | | 40 | C | A | A | B |
| 99 | | | 60 | C | A | A | B |
| 100 | | | 80 | C | A | A | B |

From the results shown in Table 1, it is revealed that the recrystallization of the steel substrate depends upon the temperature of annealing and the rolling rate, and generally takes place, as shown in Table 1 with A and B, at a temperature of at least 500° C. with some exceptions in cases of relatively low rolling rates (Nos. 1, 2, 6, 7, 11, 16, 21, 26 and 30). The recrystallization starting temperature of the aluminum coating is in general about 350° C. to 400° C.

Table 1 further reveals that the formation of the Al—Fe binary intermetallic compounds from Al—Fe mutual diffusion at the interface between the steel substrate and the Al—Si coating layer depends upon the solute N and total C content in the steel as well as the temperature of annealing; and that if the solute N content in steel is sufficiently high the steel substrate can be recrystallized without the formation of Al—Fe binary intermetallic compounds, and that a low total C content in steel makes the temperature of formation of the Al—Fe binary compounds high.

EXAMPLE 2

Rimmed steel strip specimens of a thickness of 1.2 mm containing 0.045% by weight of total C and 0.0115% by weight of solute N were prepared. Each specimen was dipped in an aluminum hot dipping bath containing a varied amount of Si within the range of between 0.4 and 16.3% by weight to provide an aluminum-silicon hot dipped steel sheet. Each sheet was rolled at the indicated rolling rate within the range of between 10% and 80%, and examined for the state of its coating and intermediate layers.

The results are shown in Table 2.

TABLE 2

| Si Content in Coating and State of Coating and Intermediate Layers after Rolling | | | |
|---|---|---|---|
| No. | Si Content in Coating (wt %) | Rolling Rate (%) | State of Coating and Intermediate Layers after Rolling |
| 1 | 0.4 | 10 | Intermediate layer cracks; and coating layers peel off |
| 2 | | 20 | Intermediate layer cracks; and coating layers peel off |
| 3 | | 40 | Intermediate layer cracks; and coating layers peel off |
| 4 | | 60 | Intermediate layer cracks; and coating layers peel off |
| 5 | | 80 | Intermediate layer cracks; and coating layers peel off |
| 6 | 1.9 | 10 | Intermediate layer is not divided into sections |
| 7 | | 20 | Intermediate layer is not divided into sections |
| 8 | | 40 | Good |
| 9 | | 60 | Good |
| 10 | | 80 | Many micro-cracks in coating layers |
| 11 | 8.3 | 10 | Intermediate layer is not divided into sections |
| 12 | | 20 | Intermediate layer is not divided into sections |
| 13 | | 40 | Good |
| 14 | | 60 | Good |
| 15 | | 80 | Many micro-cracks in coating layers |
| 16 | 14.2 | 10 | Intermediate layer is not divided into sections |
| 17 | | 20 | Intermediate layer is not divided into sections |
| 18 | | 40 | Good |
| 19 | | 60 | Good |
| 20 | | 80 | Many micro-cracks in coating layers |
| 21 | 16.3 | 10 | Coating layers heavily crack and locally peel off |
| 22 | | 20 | Coating layers heavily crack and locally peel off |
| 23 | | 40 | Coating layers heavily crack and locally peel off |
| 24 | | 60 | Coating layers heavily crack and locally peel off |
| 25 | | 80 | Coating layers heavily crack and locally peel off |

As shown in Table 2, when the aluminum coated steel sheet having Al—Si coating layers whose Si content is 0.4% by weight, prepared by hot dipping in an aluminum hot dipping bath containing 0.4% by weight of Si, is rolled, the intermediate layer cracks without being suitably divided into sections thereby causing the coating layers to readily peel off, irrespectively of the rolling rate (Nos. 1 to 5). The thickness of the intermediate layer before rolling was about 17 to 18 μm.

When the aluminum coated steel sheet prepared by hot dipping in an aluminum hot dipping bath containing 16.3% by weight of Si, and thus having Al—Si coating layers whose Si content is 16.3%, is rolled, the coating layers crack heavily and locally peel off (Nos. 21 to 25). The Al—Si hot dipped steel sheet contained hard and brittle platelets of Si in its coating layers.

Table 2 further reveals that in cases wherein the Si content of the coating layers is 1.9%, 8.3% or 14.2%, good results are obtainable with a moderate rolling rate of 40% or 60%, while a low rolling rate such as 10% or 20% does not suitably divide the intermediate layer into sections, and an excessively high rolling rate such as 80% results in the formation of many micro-cracks in the coating layers (Nos. 6 to 20).

EXAMPLE 3

Aluminum silicon hot dipped steel sheets, having varied coating build-up within the range of between 45 and 200 g/m$^2$, were prepared by dipping rimmed steel strips, having varied thicknesses within the range of between 0.45 and 2.0 mm and containing 0.043% by weight of total C and 0.0085% by weight of solute N, in an aluminum hot dipping bath containing 10% by weight of Si. Each Al—Si hot dipped steel sheet was rolled at the indicated rolling rate within the range of between 10% and 80%, and annealed at a temperature of 530° C. for a period of 10 hours. The thickness of the starting rimmed steel strip and the coating build-up of the Al—Si hot dipped steel sheet were selected within the ranges indicated above so that the rolled sheet had a thickness of 0.4 mm and a coating build-up of 40 g/m$^2$ per one side. In this manner eight samples (Nos. 1 to 8) were prepared.

Each sample was examined for the extent of division of the intermediate layer by observing its structural section taken along the direction of rolling, and the values of P and Q, defined above were determined.

Each sample was subjected to the close bend prescribed in JIS Z 2248 (1975), that is the most severe bend with an inside diameter of zero to a bend angle of 180°. The outside surface of bent area of the sample was examined for the occurrence of cracks in coating layer.

The closely bent sample was then subjected to a salt spray test in accordance with JIS Z 2371 (1976), and the elapsed time before the occurrence of red rust pits was determined for both bent and flat areas of the sample.

The results are shown in Table 3, which also shows the results of the same tests carried out on a control sample (No. 9), a commercially available Al—Si hot dipped steel sheet having a thickness of 0.4 mm and a coating buildup of 40 g/m$^2$ per one side.

TABLE 3

| No. | Rolling Rate (%) | Coating Build-up per One Side (g/m$^2$) | Extent of Division of Intermediate Layer Q | Extent of Division of Intermediate Layer P | Occurrence of Cracks in Coating When Closely Bent | Spray Test (Days Before Occurrence of Red Rust Pits) Flat Area | Spray Test (Days Before Occurrence of Red Rust Pits) Bent Area |
|---|---|---|---|---|---|---|---|
| 1 | 10 | 40 | 3.5(%) | 12.5(μm) | heavy cracks | 59 | 5 |
| 2 | 20 | 40 | 7.6 | 10.2 | micro-cracks | 61 | 12 |
| 3 | 30 | 40 | 14.2 | 9.0 | no cracks | 60 | 56 |

TABLE 3-continued

| No. | Rolling Rate (%) | Coating Build-up per One Side ($g/m^2$) | Extent of Division of Intermediate Layer Q | Extent of Division of Intermediate Layer P | Occurrence of Cracks in Coating When Closely Bent | Spray Test (Days Before Occurrence of Red Rust Pits) Flat Area | Spray Test (Days Before Occurrence of Red Rust Pits) Bent Area |
|---|---|---|---|---|---|---|---|
| 4 | 40 | 40 | 19.8 | 8.2 | no cracks | 61 | 54 |
| 5 | 50 | 40 | 28.3 | 7.5 | no cracks | 59 | 55 |
| 6 | 60 | 40 | 37.0 | 7.0 | no cracks | 63 | 58 |
| 7 | 70 | 40 | 46.2 | 6.7 | no cracks | 58 | 52 |
| 8 | 80 | 40 | 54.8 | 6.5 | micro-cracks | 6 | 6 |
| 9 | 0 | 40 | 0 | — | heavy cracks | 30 | 5 |

EXAMPLE 4

(1) Steel Strips

Using a molten steel from a converter essentially consisting of 0.063% by weight of total C, a trace of Si, 0.30% by weight of Mn, 0.018% by weight of P, 0.011% by weight of S and 0.0018% by weight of solute N, the balance being Fe, ingots having various solute N content were prepared by adding various appropriate amounts of MnN to a mold at the time of molding the ingots. The ingots were then bloomed, deflamed, hot rolled, pickled and cold rolled in conventional manner, and then annealed and decarburized in a wet hydrogen atmosphere to various extents whereby steel strips Nos. 1 to 8 listed in Table 4 below having the indicated various total C and solute N contents and a thickness of 0.8 mm were prepared.

TABLE 4

| No. | Steel Strips to be Hot Dipped: Contained in Steel % by weight of total C | solute N | Remarks |
|---|---|---|---|
| 1 | 0.005 | 0.0018 | Control |
| 2 | 0.006 | 0.0063 | Suitable for practice of |
| 3 | 0.018 | 0.0084 | The invention |
| 4 | 0.045 | 0.0023 | Used heretofore |
| 5 | 0.041 | 0.0107 | Suitable for practice of the invention |
| 6 | 0.058 | 0.0036 | Used heretofore |
| 7 | 0.061 | 0.0071 | Suitable for practice |
| 8 | 0.054 | 0.0105 | The invention |

(2) Aluminum Hot Dipped Steel Sheets

Each steel strip listed in Table 4 having a thickness of 0.7 mm was degreased and pickled in conventional manner, and then dipped for 5 seconds in an Al-9.5% Si hot dipping bath maintained at a temperature of 670° C. to provide an aluminum hot dipped steel sheet having a coating build-up of 80 $g/m^2$ per one side.

Each sheet was rolled at a rolling rate of 50%, and then annealed for 10 hours at 530° C. to provide a product having a thickness of 0.4 mm and a coating build-up of 40 $g/m^2$ per one side.

(3) Close Bend Test

A sample taken from each product was subjected to the close bend in accordance with JIS Z 2248 (1975), and the outside surface of the bent area was examined for the occurrence of cracks in the coating layer. The result was estimated by the key for formability rating listed in Table 5, and shown in Table 6.

TABLE 5

| Key for Formability Rating: Rating | State |
|---|---|
| a | Coating layer does not crack |
| b | Coating layer cracks slightly |
| c | Coating layer cracks heavily |

(4) Salt Spray Test

Each closely bent sample was tested for the corrosion resistance by the Method of Salt Spray Testing in accordance with JIS Z 2371 (1976), and the time elapsed before the occurrence of red rust pits was determined for both flat and closely bent areas of the sample. The results are shown in Table 6.

Table 6 further shows the results of the same tests carried out on a sample (No. 9) taken from a commercially available Al—Si hot dipped steel sheet having a thickness of 0.4 mm and a coating build-up of 40 $g/m^2$ per one side, the steel essentially consisting of 0.045% by weight of total C, a trace of Si, 0.30% by weight of Mn, 0.018% by weight of P, 0.011% by weight of S, and 0.002% by weight of solute N, the balance being Fe.

TABLE 6

| Sample No. | Close Bend Test | Salt Spray Test (Days Before Occurrence of Red Rust Pits) Flat Area | Salt Spray Test (Days Before Occurrence of Red Rust Pits) Bent Area | Remarks |
|---|---|---|---|---|
| 1 | c | 2 | 2 | Control (Shortage of N in Steel) Surfaces discolored dark grey |
| 2 | a | 63 | 59 | According to the invention |
| 3 | a | 60 | 57 | According to the invention |
| 4 | c | 3 | 2 | Heretofore used steel. Surfaces discolored dark grey. |
| 5 | a | 68 | 60 | According to the invention |
| 6 | c | 2 | 2 | Heretofore used steel. Surfaces discolored dark grey |
| 7 | a | 59 | 55 | According to the invention |
| 8 | a | 63 | 58 | According to the invention |
| 9 | c | 30 | 7 | Commercially available Al—Si hot dipped |

TABLE 6-continued

| Formability and Corrosion Resistance of Al—Si Hot Dipped Steel Sheets | | | | |
|---|---|---|---|---|
| Sample No. | Close Bend Test | Salt Spray Test (Days Before Occurrence of Red Rust Pits) Flat Area | Bent Area | Remarks |
| | | | | steel sheet |

EXAMPLE 5

Al—Si Hot Dipped Steel Sheet According to the Invention

A steel strip having a thickness of 0.7 mm and containing 0.015% by weight of total C and 0.0085% by weight of solute N, was prepared as described in Example 4,(1). The strip was degreased and pickled in conventional manners, and then dipped for 5 seconds in an Al-4.8% Si bath maintained at a temperature of 680° C. to provide an aluminum hot dipped steel sheet having a coating build-up of 80 g/m$^2$ per one side. The aluminum hot dipped steel sheet was then rolled with a rolling rate of 50% and annealed at a temperature of 550° C. for 6 hours to produce a product in accordance with the invention. The product (No. 11) had a thickness of 0.35 mm and a coating build-up of 40 g/m$^2$ per one side.

Control Products

The control products (Nos. 12 to 14) used were commercially available Al—Si hot dipped steel sheets of a thickness of 0.35 mm having coating build-up of 40 g/m$^2$, 60 g/m$^2$ and 80 g/m$^2$, respectively, the steel of the products essentially consisting of 0.054% by weight of total C, a trace of Si, 0.30% by weight of Mn, 0.013% by weight of P, 0.010% by weight of S and 0.0021% by weight of solute N, the balance being Fe.

Samples taken from the product according to the invention and from control products, were tested for the formability and corrosion resistance in the manner described in Example 4, (3) and (4).

The results are shown in Table 7.

TABLE 7

| Formability and Corrosion Resistance of Al—Si Hot Dipped Steel Sheets | | | | | | |
|---|---|---|---|---|---|---|
| No. | Coating Build-up per one side (g/m$^2$) | Contained in Steel % by weight of total C | solute N | Close Bend Test | Salt Spray Test (Days Before Occurrence of Red Rust Pits) Flat Area | Bent Area |
| 11 | 40 | 0.015 | 0.0083 | a | 62 | 57 |
| 12 | 40 | 0.054 | 0.0021 | c | 29 | 6 |
| 13 | 60 | 0.054 | 0.0021 | b | 55 | 15 |
| 14 | 80 | 0.054 | 0.0021 | b | 72 | 20 |

EXAMPLE 6

A steel strip having a thickness of 0.7 mm and containing 0.018% by weight of total C and 0.064% by weight of solute N, was prepared as described in Example 4, (1). The strip was degreased and pickled in conventional manner, and then dipped for 5 seconds in an Al—6.7% Si bath maintained at a temperature of 650° C. to provide an aluminum hot dipped steel sheet having a coating build-up of 80 g/m$^2$ per one side.

Portions of the hot dipped steel sheet were rolled at varied rolling rates indicated in Table 8, and then annealed at a temperature of 530° C. for 10 hours to provide 8 products listed in the same table.

On samples taken from these products, the test described in Example 4, (3) and (4) were carried out.

The results are shown in Table 8.

TABLE 8

| Formability and Corrosion Resistance of Rolled and Annealed Al—Si Hot Dipped Steel Sheets | | | | | | |
|---|---|---|---|---|---|---|
| No. | Rolling Rate (%) | Thickness of Sheet (mm) | Coating Build-up per one side (g/m$^2$) | Close Bend Test | Salt Spray Test (Days Before Occurrence of Red Rust Pits) Flat Area | Bent Area |
| 21 | 10 | 0.63 | 72 | c | 75 | 17 |
| 22 | 20 | 0.56 | 64 | b | 72 | 15 |
| 23 | 30 | 0.50 | 56 | a | 69 | 63 |
| 24 | 40 | 0.42 | 48 | a | 65 | 60 |
| 25 | 50 | 0.35 | 40 | a | 62 | 56 |
| 26 | 60 | 0.28 | 32 | a | 59 | 50 |
| 27 | 70 | 0.21 | 24 | a | 58 | 52 |
| 28 | 80 | 0.14 | 16 | b | 7 | 6 |

What we claim is:

1. An aluminum hot dip coated steel sheet consisting essentially of (1) a steel substrate containing 0.002 to 0.02% by weight of solute N and not more than $\sqrt{5/3N-1/300}$% by weight of total C, wherein N represents the percentage of the solute N, and having a recrystallized structure;

(2) an aluminum coating layer on at least one surface of said steel substrate comprising essentially Al and 1 to 15% by weight of spheroidal Si and having a recrystallized structure, and:

(3) a discontinuous intermediate layer at the interface between said steel substrate and aluminum coating layer and comprising essentially Al—Fe—Si intermetallic compounds.

2. An aluminum hot dip coated steel sheet according to claim 1 wherein, when observed on a longitudinal cross-section, said discontinuous intermediate layer comprises successive discrete islands comprising essentially Al—Fe—Si intermetallic compounds, the individual islands having an average size of not larger than 10 μm with the sum of gaps between adjacent islands being 10 to 50% of the total length of said islands and said gaps.

3. A process for the production of an aluminum coated steel sheet comprising the steps of (a) rolling an aluminum hot dip coated steel sheet, which comprises a steel substrate containing 0.002 to 0.02% by weight of solute N and not more than $\sqrt{5/3N-1/300}$% by weight of total C, wherein N represents the percentage by weight of the solute N; an aluminum coating layer on at least one surface of said steel substrate comprising essentially Al and 1 to 15% by weight of Si, and; a continuous intermediate layer between said steel substrate and aluminum coating layer and comprising essentially Al—Fe—Si intermediate compounds, at a rolling rate sufficient to cause division of said continuous intermediate layer into sections, and (b) annealing the rolled aluminum coated steel sheet at a temperature sufficient for the recrystallization of said steel substrate but insufficient for Al—Fe mutual diffusion between said steel substrate and aluminum coating layer.

4. A process according to claim 3 wherein the rolling step is carried out at a rolling rate sufficient to divide said continuous intermediate layer into successive discrete islands when observed on a cross-section taken along the direction of rolling, the individual islands having an average size of not larger than 10 μm with the sum of gaps between adjacent islands being 10 to 50% of the total length of said islands and gaps.

5. A process according to claim 3 wherein the rolling step is carried out at a rolling rate of 30 to 70% and the annealing step is carried out at a temperature of from 500° to 600° C.

* * * * *